US012428852B2

(12) United States Patent
Walker et al.

(10) Patent No.: US 12,428,852 B2
(45) Date of Patent: Sep. 30, 2025

(54) GLASS FENCING SYSTEM

(71) Applicant: Peak Innovations Inc., Richmond (CA)

(72) Inventors: Simon Walker, Delta (CA); Craig Lawson, Burnaby (CA); Charles Young, Vancouver (CA); Adam Mantei, Burnaby (CA)

(73) Assignee: Peak Innovations Inc., Richmond (CA)

( * ) Notice: Subject to any disclaimer, the term of this patent is extended or adjusted under 35 U.S.C. 154(b) by 239 days.

(21) Appl. No.: 18/279,281

(22) PCT Filed: Mar. 30, 2022

(86) PCT No.: PCT/CA2022/050481
§ 371 (c)(1),
(2) Date: Aug. 29, 2023

(87) PCT Pub. No.: WO2022/204812
PCT Pub. Date: Oct. 6, 2022

(65) Prior Publication Data

US 2024/0141652 A1 May 2, 2024

Related U.S. Application Data

(60) Provisional application No. 63/167,846, filed on Mar. 30, 2021.

(51) Int. Cl.
*E04F 11/18* (2006.01)
*E04H 17/16* (2006.01)
(Continued)

(52) U.S. Cl.
CPC ..... *E04F 11/1853* (2013.01); *E04F 11/1808* (2013.01); *E04F 11/1812* (2013.01);
(Continued)

(58) Field of Classification Search
CPC ..... E04F 11/1853; E04F 11/1808; E04F 11/1812; E04F 11/1817; E04F 2011/1829;
(Continued)

(56) References Cited

U.S. PATENT DOCUMENTS 4,054,268 A * 10/1977 Sher ..... E04F 11/1812 256/67
4,920,717 A * 5/1990 Hooper, Jr. ..... E04F 11/1812 52/204.597
(Continued)

FOREIGN PATENT DOCUMENTS

AU 2018100559 A4 * 5/2018 ..... E04F 11/1812
AU 2018203647 A1 8/2018
(Continued)

OTHER PUBLICATIONS

International Search Report for PCT/CA2022/050481, dated Jul. 12, 2022.
Written Opinion for PCT/CA2022/050481, dated Jul. 12, 2022.

*Primary Examiner* — Brian E Glessner
(74) *Attorney, Agent, or Firm* — Oyen Wiggs Green & Mutala LLP

(57) ABSTRACT

A glass fencing system includes glass panels, rails, gaskets, and spigots. The rails extend across the upper edges of the glass panels. The gaskets are fitted within the rails. The spigots support one of the glass panels and comprise a base, a first arm, a first pad, a second arm, and a second pad. The first pad has a first pad surface and a lower surface. The first pad surface is in contact with the first arm and the glass panel. The lower surface extends from the first pad surface and is in contact with the glass panels. The second arm has bores. The second pad has a second pad surface, a backing, a plate, and fasteners. The second pad surface is in contact with the glass panel. The backing is spaced apart from the second pad surface and has backing openings aligned with
(Continued)

the bores. The plate is located between the second pad surface and the backing. The fasteners pass through the bores and the backing openings to contact the plate.

20 Claims, 9 Drawing Sheets

(51) Int. Cl.
*E04H 17/20* (2006.01)
*E04H 17/22* (2006.01)

(52) U.S. Cl.
CPC ..... *E04F 11/1817* (2013.01); *E04H 17/1602* (2021.01); *E04H 17/21* (2021.01); *E04H 17/22* (2013.01); *E04F 2011/1829* (2013.01)

(58) Field of Classification Search
CPC ..... E04F 2011/1831; E04H 17/16; E04H 17/1602
USPC ..... 256/24
See application file for complete search history.

(56) References Cited

U.S. PATENT DOCUMENTS

| | | | | |
|---|---|---|---|---|
| 7,530,549 | B1 * | 5/2009 | Hansen | E04F 11/1834 256/60 |
| 7,559,536 | B1 * | 7/2009 | Hansen | E04F 11/1851 256/25 |
| 8,500,110 | B2 | 8/2013 | Allen | |
| 9,169,640 | B2 * | 10/2015 | Jeffers | E04B 2/7422 |
| 9,995,043 | B2 | 6/2018 | Bierman | |
| 10,030,393 | B2 | 7/2018 | Spence et al. | |
| 10,669,770 | B1 | 6/2020 | Pittella | |
| 2007/0029534 | A1 * | 2/2007 | Adderton | E04F 11/181 256/24 |
| 2016/0281366 | A1 * | 9/2016 | Spence | E04F 11/1853 |
| 2016/0298337 | A1 * | 10/2016 | Header | E04F 11/1812 |
| 2019/0271161 | A1 * | 9/2019 | Culp | E04F 11/1817 |
| 2023/0358054 | A1 * | 11/2023 | Ruprecht | E04F 11/1853 |
| 2025/0034879 | A1 * | 1/2025 | Schlatter | E04F 11/1834 |

FOREIGN PATENT DOCUMENTS

| | | | | |
|---|---|---|---|---|
| AU | 2020100948 | A4 | 7/2020 | |
| AU | 2020103975 | A4 | 2/2021 | |
| DE | 202014106053 | U1 * | 3/2016 | E04F 11/1853 |
| WO | WO-2019173881 | A1 * | 9/2019 | E04F 11/1812 |

* cited by examiner

GLASS FENCING SYSTEM

FIELD OF THE INVENTION

The present invention relates to fence and railing systems, and in particular, to glass fencing systems.

BACKGROUND OF THE INVENTION

Fence and railing systems for any number of outdoor applications are well known. For example, residential decks, pool decks, and playgrounds all utilize any number of conventional fence and railing systems. Such systems typically comprise one or more railings (e.g. an upper railing and/or a lower railing) with pickets or panels extending from the railings.

One common type of fencing is glass fencing. Glass fencing is commonly used for decks and other outdoor applications because the glass panels used in glass fencing systems allow for greater visibility through the panels. However, glass is prone to breakage, and broken glass is potentially dangerous, both in terms of the resulting glass shards or pieces injuring people and in terms of the broken glass no longer providing barrier protection for the fencing system. It is therefore known to use tempered glass or laminated glass in order to provide some protection against glass breakage.

It is desirable for a glass fencing system that is safe and easy to install.

SUMMARY OF THE INVENTION

A glass fencing system in accordance with one embodiment of the invention comprises one or more glass panels arranged in an end-to-end manner. One or more rails span across an upper edge of the glass panels. The rails comprise a pair of first descending portions with a first planar portion extending between the first descending portions. The rails further comprise gaskets that fit within the first descending portions and the first planar portion and engages with the upper edge of the glass panels.

The glass panels are supported at their lower edge by one or more spigots. The spigots comprise first and second arms extending from a base. First and second pads separate the first and second arms from the glass panels. The first pad may be substantially L-shaped, comprising a vertical and a horizontal portion. The horizontal portion engages the lower edge of the glass panels.

In one embodiment of the invention, a glass fencing system for attachment to a structure comprises a plurality of glass panels, a plurality of rails, one or more gaskets, and a plurality of spigots. Each of the glass panels comprises a panel upper edge and a panel lower edge. The plurality of rails extends across the panel upper edges of the glass panels. Each of the rails comprises a planar portion and a pair of descending portions extending from the planar portion. Each of the gaskets comprises a gasket planar portion in contact with the planar portion and a pair of gasket descending portions extending from the gasket planar portion. The gasket descending portions are in contact with the descending portions. Each of the spigots supports one of the glass panels. Each of the spigots comprises a base, a first arm extending from the base, a first pad, a second arm extending from the base, and a second pad. The first pad is removably attached to the first arm and comprises a first pad surface and a lower surface. The first pad surface is in contact with the first arm and the glass panel. The lower surface extends from the first pad surface and is in contact with the lower edge of the one of the glass panels. The second arm comprises one or more bores. The second pad is removably attached to the second arm and comprises a second pad surface, a backing, a plate, and one or more arm fasteners. The second pad surface is in contact with the glass panel. The backing is spaced apart from the second pad surface and comprises one or more backing openings aligned with the one or more bores. The plate is located between the second pad surface and the backing. The arm fasteners are adapted to engage within the one or more bores and are further adapted to pass through the one or more bores and the one or more backing openings to contact the plate.

In another embodiment, each of the rails further comprises an upper planar portion and a pair of outer descending portions extending from the upper planar portion. The upper planar portion is spaced apart from the planar portion, and the outer descending portions are spaced apart from the descending portions.

In still another embodiment, each of the rails further comprises a pair of connector portions extending between the outer descending portions and the inner descending portions.

In still yet another embodiment, the upper planar portion, the planar portion, the outer descending portions, the descending portions, and the connector portions define, at least in part, a rail enclosure.

In a further embodiment, the gasket planar portion and the gasket descending portions define, at least in part, a gasket channel that is adapted to receive one of the glass panels.

In still a further embodiment, each of the gaskets further comprises one or more gasket projections extending from the gasket descending portions into the gasket channel, the one or more gasket projections adapted to grip one of the glass panels.

In still yet a further embodiment, the glass fencing system further comprises one or more connectors adapted to join two of the rails together.

In another embodiment, the connectors comprise one or more of the following: a rail connector, a corner connector, and an angle connector.

In still another embodiment, the rail connector comprises a rail connector planar portion and a pair of rail connector descending portions extending from the rail connector planar portion. The rail connector planar portion and the rail connector descending portions are adapted to engage with the rail enclosure of both of the two of the rails.

In yet another embodiment, the corner connector comprises corner connector first and second arms. Each of the corner connector first and second arms comprises a corner connector planar portion and a pair of corner connector descending portions extending from the corner connector planar portion. The corner connector first arm is adapted to engage with the rail enclosure of a first one of the two rails. The corner connector second arm is adapted to engage with the rail enclosure of a second one of the two rails.

In a further embodiment, the angle connector comprises angle connector first and second arms and an angle connector joint connected to the angle connector first and second arms. The angle connector joint is adapted to allow for pivoting of the angle connector first arm with respect to the angle connector second arm. Each of the angle connector first and second arms comprises an angle connector planar portion and a pair of angle connector descending portions extending from the angle connector planar portion. The angle connector first arm is adapted to engage with the rail enclosure of a first one of the two rails. The angle connector second arm is adapted to engage with the rail enclosure of a second one of the two rails.

In still a further embodiment, the glass fencing system further comprises one or more posts. One of the rails is adapted to attach to each of the one or more posts.

In still yet a further embodiment, the glass fencing system further comprises an end connector adapted to attach the one of the rails to the one or more posts.

In another embodiment, the first pad further comprises one or more first clips extending from the first pad surface. The first arm comprises a first frame, and the one or more first clips are adapted to engage the first frame to removably attach the first pad to the first arm.

In still another embodiment, the first pad further comprises one or more lower protrusions extending from the lower surface. The base comprises one or more base openings. The one or more lower protrusions are adapted to engage with the one or more base openings when the first pad is attached to the first arm.

In still yet another embodiment, the second pad further comprises one or more sidewalls extending between the second pad surface and the backing. The sidewalls, the second pad surface, and the backing define, at least in part, a plate enclosure for accepting the plate.

In a further embodiment, the bores are threaded.

In still a further embodiment, the one or more arm fasteners are adapted to threadedly engage with the one or more bores.

In another embodiment, contact of the one or more arm fasteners with the plate causes the plate to deflect in a direction against the second pad surface.

In still another embodiment, deflection of the plate against the second pad surface causes the second pad surface to press against the glass panel.

In still yet another embodiment, the second pad further comprises one or more second clips extending from the backing. The second arm comprises a second frame. The one or more second clips are adapted to engage the second frame to removably attach the second pad to the second arm.

In a further embodiment, each of the spigots further comprise a base plate attached to the base. The base plate is adapted to be attached to the structure.

In still a further embodiment, the base plate comprises one or more base plate openings adapted to receive deck fasteners for attaching the base plate to the structure.

In another embodiment, a spigot for use in supporting a glass panel in a glass fencing system comprises a base, a first arm, a first pad, a second arm, and a second pad. The first pad is removably attached to the first arm and comprises a first pad surface and a lower surface. The first pad surface is in contact with the first arm and the glass pane. The lower surface extends from the first pad surface and is in contact with the lower edge of the one of the glass panel. The second arm comprises one or more bores. The second pad is removably attached to the second arm and comprises a second pad surface, a backing, a plate, and one or more arm fasteners. The second pad surface is in contact with the glass panel. The backing is spaced apart from the second pad surface and comprises one or more backing openings aligned with the one or more bores. The plate is located between the second pad surface and the backing. The arm fasteners are adapted to engage within the one or more bores and are further adapted to pass through the one or more bores and the one or more backing openings to contact the plate.

The foregoing was intended as a summary only and of only some of the aspects of the invention. It was not intended to define the limits or requirements of the invention. Other aspects of the invention will be appreciated by reference to the detailed description of the preferred embodiments.

BRIEF DESCRIPTION OF THE DRAWINGS

The embodiments of the invention will be described by reference to the drawings thereof, in which.

DETAILED DESCRIPTION OF THE INVENTION

Figure 1:
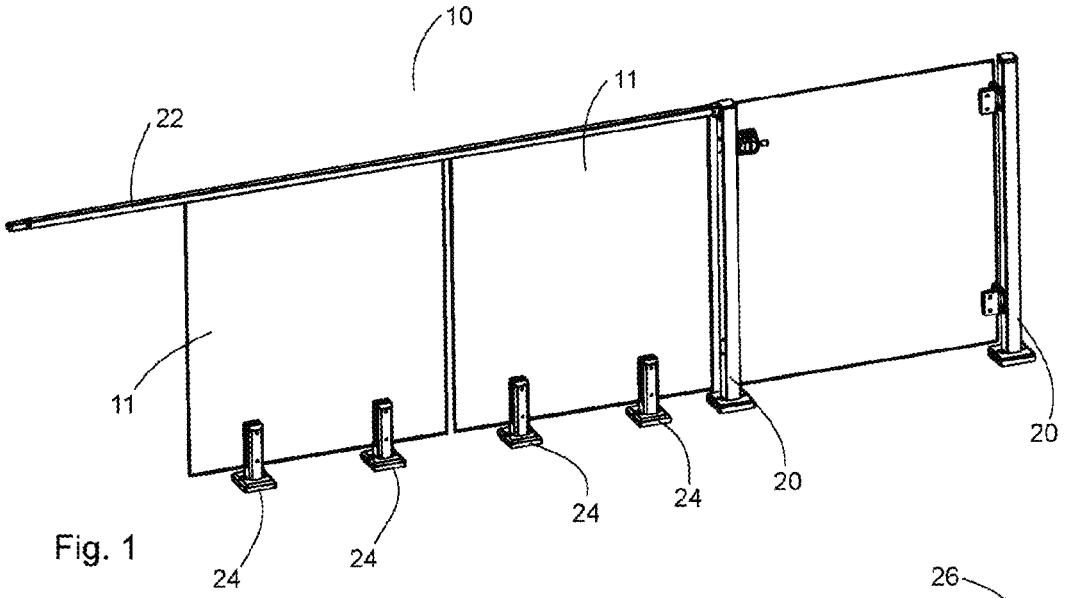
FIG. 1 depicts a fencing system in accordance with one embodiment of the invention.
Figure 2:
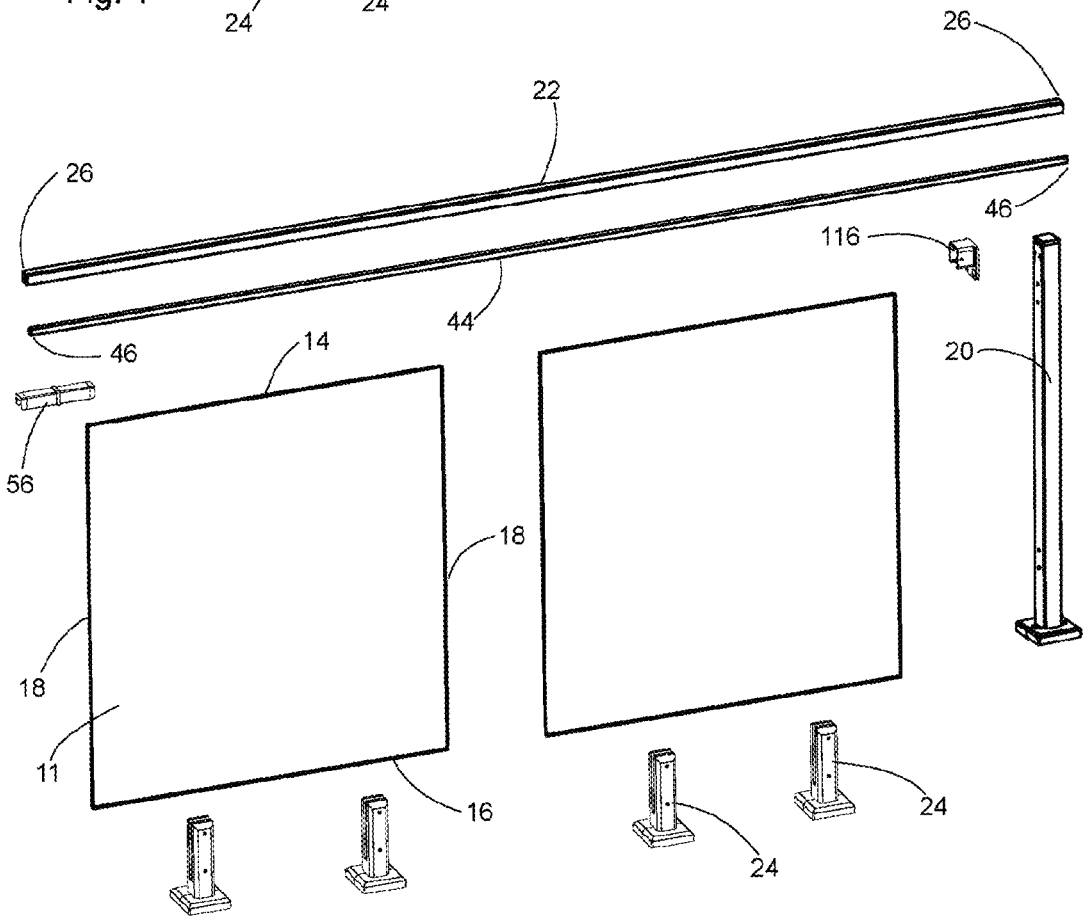
FIG. 2 is an exploded view showing components of the fencing system.

Referring to FIGS. 1 and 2, a fencing system 10 in accordance with the invention comprises one or more glass panels 11 arranged in a substantially end-to-end manner. Preferably, the glass panels 11 are substantially rectangular in shape and formed from tempered glass. Each of the glass panels 11 comprises panel first and second faces 12, 13, a panel upper edge 14, a panel lower edge 16, and panel lateral edges 18. The fencing system 10 further comprises one or more posts 20 that are preferably arranged substantially vertically. One of the posts 20 may separate adjacent ones of the glass panels 11. However, it is not necessary that one of the posts 20 separate every adjacent ones of the glass panels 11. In other words, two or more of the glass panels 11 may be present between two of the posts 20.

In addition, the fencing system 10 further comprises one or more rails 22. The rails 22 engage the glass panels 11 along the panel upper edges 14, with the rails 22 extending in between the posts 20. The fencing system 10 also comprises one or more spigots 24 for supporting the glass panels 11 by the panel lower edge 16.

A length for each of the rails 22 may vary and may not necessarily coincide with a length of the glass panels 11. For example, the length for one of the rails 22 may be greater than or less than the length of one of the glass panels 11. In one embodiment, one of the rails 22 may extend across two or more of the glass panels 11. Furthermore, depending on the distance between two of the posts 20, a number of the rails 22 may be needed in order to span the distance between the successive posts 20.

Figure 3:
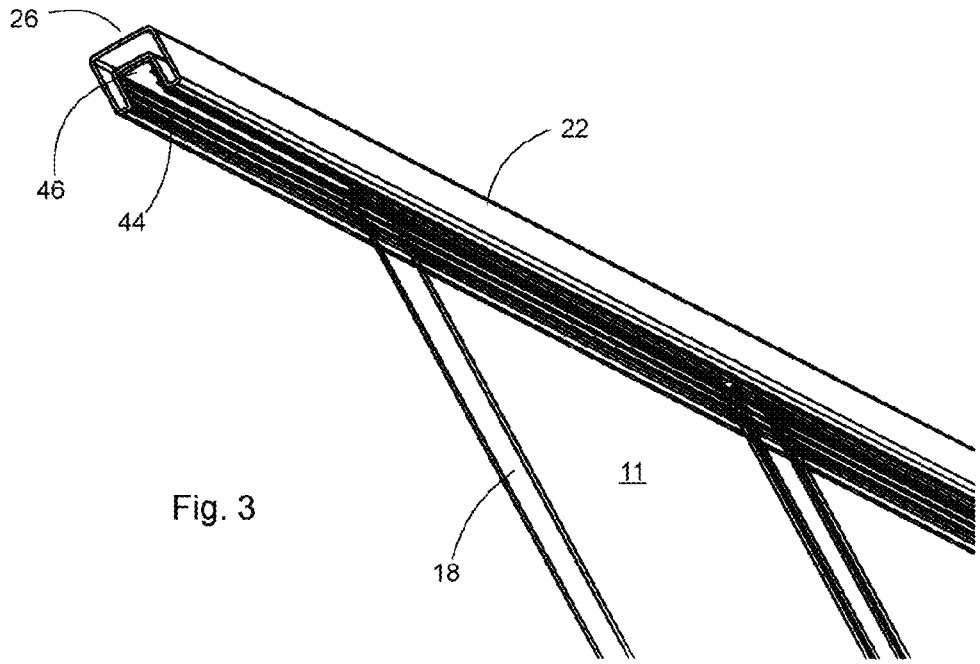
FIG. 3 is a perspective view of the fencing system, viewed from below.
Figure 4:
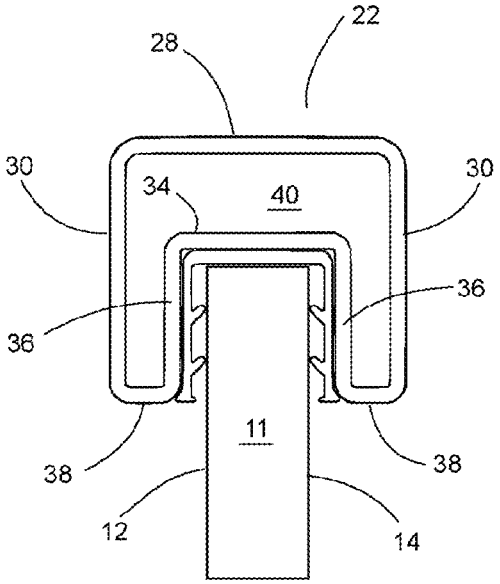
FIG. 4 is a front partial view of the fencing system.
Figure 5:
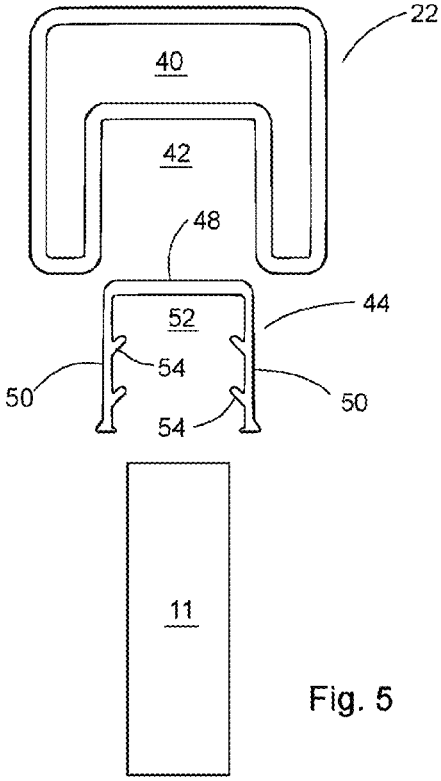
FIG. 5 is an exploded view of FIG. 4.

Referring to FIGS. 3 to 5, each of the rails 22 comprises longitudinal rail ends 26. The rail 22 further comprises an upper planar portion 28 that extends between the rail ends 26 and a pair of outer descending portions 30 that extend downwardly from the upper planar portion 28. The upper planar portion 28 and the outer descending portions 30 generally define, at least in part, a rail periphery that may be used as a grip or handle for the rail 22.

The rail 22 further comprises a lower planar portion 34 that is preferably spaced apart from the upper planar portion 28. A pair of inner descending portions 36 extend downwardly from the lower planar portion 34. The inner descending portions 36 are preferably spaced apart from the outer descending portions 30. A connector portion 38 extends between one of the outer descending portions 30 and one of the inner descending portions 36. Preferably, the upper and lower planar portions 28, 34, the outer and inner descending portions 30, 36, and the connector portions 38 define, at least in part, a substantially hollow rail enclosure 40 that extends along a length of the rail 22.

Referring to FIGS. 4 and 5, the rail 22 further comprises an elongated rail channel 42 that extends between the rail ends 26. The rail channel 42 is defined, at least in part, by the lower rail portion 34 and the inner descending portions 36. The fencing system 10 comprises one or more elongated gaskets 44, with the rail channel 42 adapted to engage with the gaskets 44. Each of the gaskets 44 comprises longitudinal gasket ends 46. Preferably, the gaskets 44 are of approximately a same length as a length of the rails 22, such that each of the gaskets 44 extends substantially between the rail ends 26 (e.g. the gasket ends 46 coincide substantially with the rail ends 26). However, it is possible that more than one of the gaskets 44 are needed to span the length of the rail 22 (i.e. the gaskets 44 are shorter than the rails 22). Furthermore, it is also possible that one of the gaskets 44 may extend beyond one of the rails 22 (i.e. the gaskets 44 are longer than the rails 22).

Referring to FIGS. 4 and 5, each of the gaskets 44 comprises a gasket planar portion 48 and a pair of gasket descending portions 50 extending downwardly from the gasket planar portion 48. Preferably, when the gasket 44 is engaged within the rail channel 42, the gasket planar portion 48 is in contact with the lower planar portion 34 and the gasket descending portions 50 are in contact with the inner descending portions 36. The gasket 44 further comprises a gasket channel 52 that is defined, at least in part, by the gasket planar portion 48 and the gasket descending portions 50.

The gasket channel 52 is adapted to engage with the panel upper edges 14 of the glass panels 11. For example, the panel upper edge 14 may slide into the gasket channel 52 until it is in contact with the gasket planar portion 48. Preferably, a width of the gasket channel 52 is approximately the same as a thickness of the glass panel 11, such that the glass panel 11 is able to fit snugly within the gasket channel 52. In order to accommodate glass panels 11 that are of different thicknesses, a thickness of the gasket descending portions 50 may be different for different ones of the gaskets 44. The gasket 44 may be made from rubber, plastic, or some other generally pliable material.

Preferably, the gasket 44 further comprises one or more gasket projections 54 that extend from the gasket descending portions 48 inwardly into the gasket channel 52. The gasket projections 54 preferably extend generally upwardly at an angle (as shown in FIG. _____). The gasket projections 54 help to grip the gasket 44 to grip the panel first and second faces 12, 13 of the glass panel 11 proximate to the panel upper edge 14. The gasket projections 54 are preferably sufficiently pliable such that when the glass panel 11 is inserted into the gasket channel 52, the gasket projections 54 are deflected at least slightly upwards by the panel first and second faces 12, 13. This upward deflection of the gasket projections 54 helps to grip the glass panel 11.

As discussed above, the length of the rails 22 are such that a number of the rails 22 may be needed in order to span the distance between two successive posts 20. In such a case, the fencing system 10 comprises a rail connector 56 that is configured to connect two of the rails 22 together.

Figure 6:
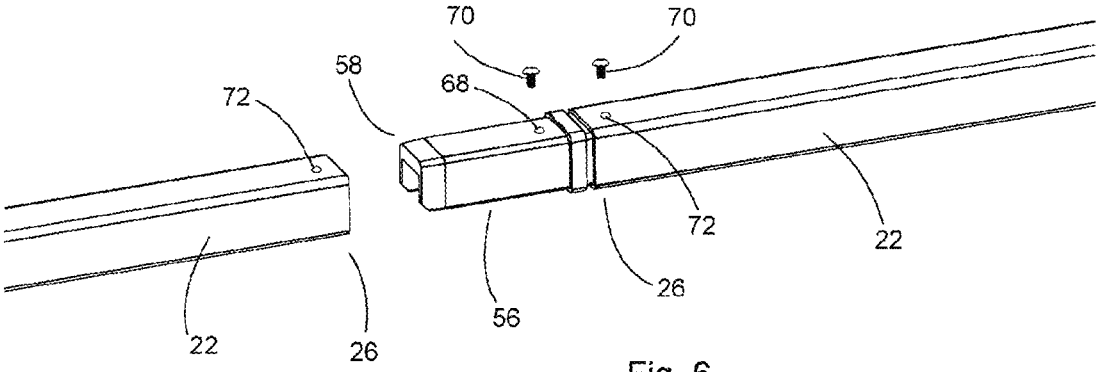
FIG. 6 is a view of a rail connector with two of the rails.
Figure 7:
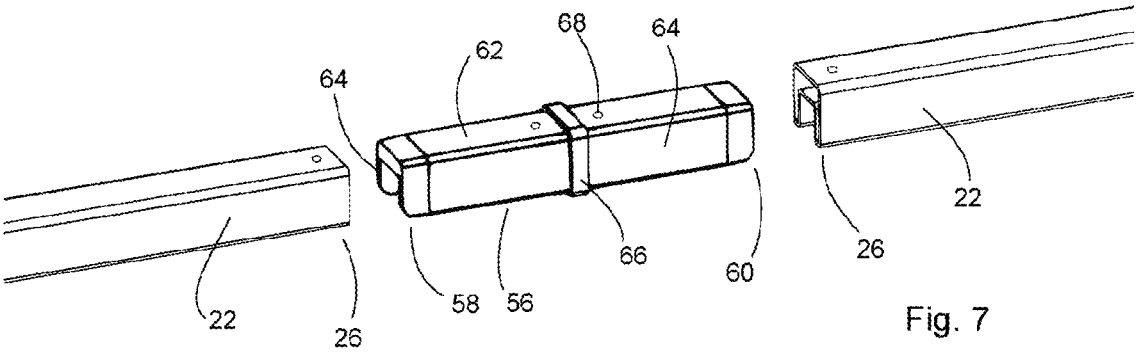
FIG. 7 is another view of the rail connector with two of the rail.
Figure 8:
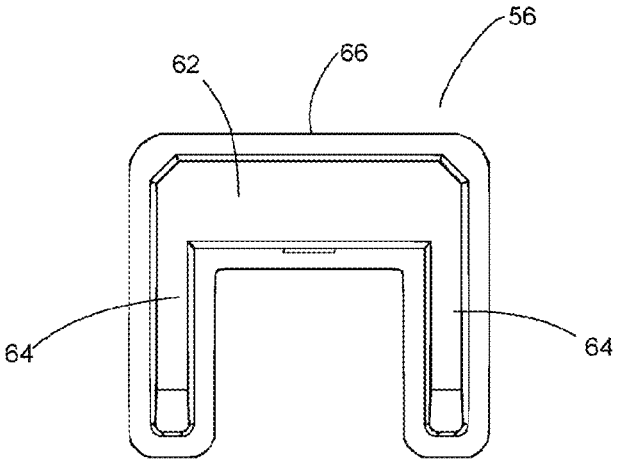
FIG. 8 is a front view of the rail connector.

Referring to FIGS. 6 to 8, the rail connector 56 comprises rail connector first and second ends 58, 60. The rail connector 56 comprises a rail connector planar portion 62 and a pair of rail connector descending portions 64 extending downwardly from the rail connector planar portion 62. The rail connector first end 58 is configured to engage with one of the rail ends 26 of a first one of the rails 22, while the rail connector second end 60 is configured to engage with one of the rail ends 26 of a second one of the rails 22, thereby connecting the rails 22 together.

In particular, the rail connector planar portion 62 and the rail connector descending portions 64 generally form an inverted U-shaped structure that is able to fit within the rail enclosure 40. For example, the rail connector planar portion 62 is able to generally fit between the upper and lower planar portions 28, 34, and the rail connector descending portions 64 are able to generally fit between the outer and inner descending portions 30, 36. Preferably, the rail connector planar portion 62 and the rail connector descending portions 64 are configured to fit snugly within the rail enclosure 40.

Referring to FIG. 7, the rail connector 56 preferably comprises a rail connector ledge 66 located between the rail connector first and second ends 58, 60, and more preferably, approximately midway between the rail connector first and second ends 58, 60. The rail connector ledge 66 protrudes from the rail connector planar portion 62 and the rail connector descending portions 64. In order to connect two of the rails 22 together, one of the rail ends 26 of a first one of the rails 22 is placed around the rail connector first end 58. The first one of the rails 22 is then slid along the rail connector 56 across the rail connector first end 58 until the rail end 26 contacts the rail connector ledge 66, which prevents the first one of the rails 22 from sliding any further along the rail connector 56. Next, one of the rail ends 26 of a second one of the rails 22 is placed around the rail connector second end 60. The second one of the rails 22 is then slid along the rail connector 56 across the rail connector second end 60 until the rail end 26 contacts the rail connector ledge 66, which also prevents the second one of the rails 22 from sliding any further along the rail connector 56. In this manner, the first and second ones of the rails 22 may be connected together in a substantially collinear alignment. Furthermore, the rail connector ledge 66 is preferably sized such that when the rails 22 are connected, the upper planar portions 28 of the rails 22 and the rail connector ledge 66 form a substantially continuous surface.

The rail connector 56 preferably comprises one or more rail connector openings 68 located proximate to the rail connector ledge 66. The rail connector openings 68 are adapted to accept rail fasteners 70 (such as screws, bolts, rivets, or the like). In one embodiment, the upper planar portion 28 of the rails 22 preferably comprises rail openings 72 proximate to the rail ends 26 that are substantially aligned with the rail connector openings 68 when the rails 22 are connected to the rail connector 56. The rail openings 72 are also adapted to accept the rail fasteners 70. By inserting the rail fasteners 70 through the rail openings 72 and the rail connector openings 68, the rails 22 may further be secured to the rail connector 56.

Figure 9:
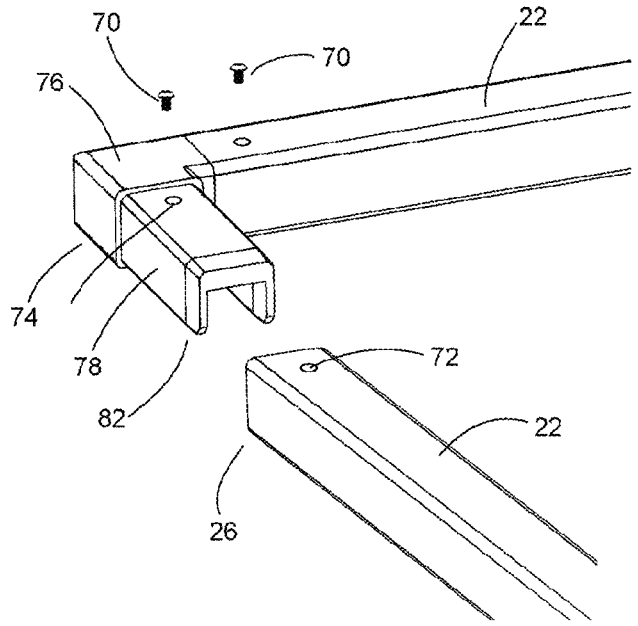
FIG. 9 is a view of a corner connector with two of the rails.
Figure 10:
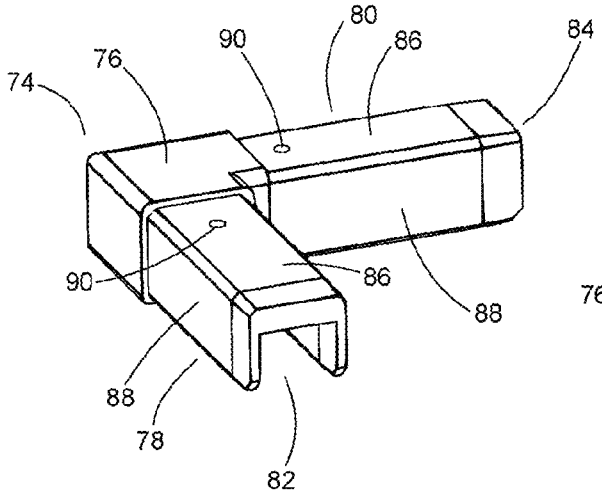
FIG. 10 is a perspective view of the corner connector, viewed from above.
Figure 11:
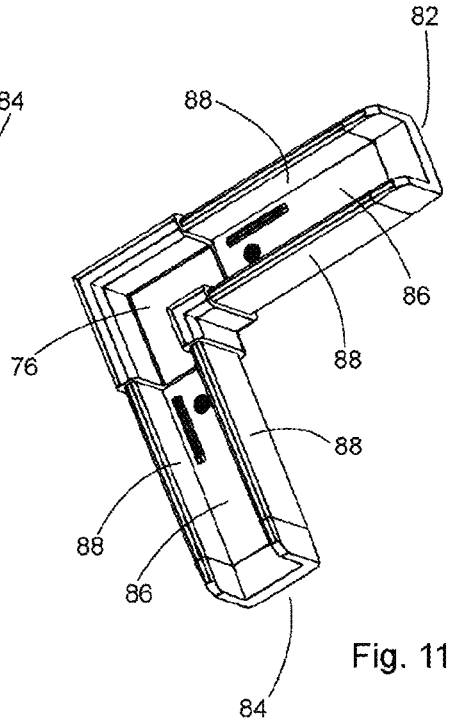
FIG. 11 is a perspective view of the corner connector, viewed from below.

The rail connector 56 may be used to connect two of the rails 22 in a substantially collinear alignment. In certain situations, it may be necessary to connect two of the rails 22 in a substantially perpendicular alignment. Referring to FIGS. 9 to 11, the fencing system 10 may further comprise a corner connector 74 that is configured to connect two of the rails 22 in a substantially perpendicular alignment. The corner connector 74 comprises a corner connector joint 76 and corner connector first and second arms 78, 80 extending from the corner connector joint 76 substantially perpendicularly from each other. The corner connector 74 further comprises corner connector first and second ends 82, 84 located at the far ends of the corner connector first and second arms 78, 80.

Each of the corner connector first and second arms 78, 80 comprises a corner connector planar portion 86 and a pair of corner connector descending portions 88 extending downwardly from the corner connector planar portion 86. The corner connector first end 82 is configured to engage with one of the rail ends 26 of a first one of the rails 22, while the corner connector second end 84 is configured to engage with one of the rail ends 26 of a second one of the rails 22, thereby connecting the rails 22 together in a substantially perpendicular alignment.

In particular, as with the rail connector 56, the corner connector planar portion 86 and the corner connector descending portions 88 generally form an inverted U-shaped structure that is able to fit within the rail enclosure 40. For example, the corner connector planar portion 86 is able to generally fit between the upper and lower planar portions 28, 34, and the corner connector descending portions 88 are able to generally fit between the outer and inner descending portions 30, 36. Preferably, the corner connector planar portion 86 and the corner connector descending portions 88 are configured to fit snugly within the rail enclosure 40.

Referring to FIG. 10, the corner connector joint 76 preferably has a greater width and height than that of the corner connector first and second arms 78, 80. In order to connect two of the rails 22 together, one of the rail ends 26 of a first one of the rails 22 is placed around the corner connector first end 82. The first one of the rails 22 is then slid along the corner connector first arm 78 across the corner connector first end 82 until the rail end 26 contacts the corner connector joint 76, which prevents the first one of the rails 22 from sliding any further along the corner connector first arm 78. Next, one of the rail ends 26 of a second one of the rails 22 is placed around the corner connector second end 84. The second one of the rails 22 is then slid along the corner connector second arm 80 across the corner connector second end 84 until the rail end 26 contacts the corner connector joint 76, which also prevents the second one of the rails 22 from sliding any further along the corner connector second arm 80. In this manner, the first and second ones of the rails 22 may be connected together in a substantially perpendicular alignment. Furthermore, the corner connector joint 76 is preferably sized such that when the rails 22 are connected, the upper planar portions 28 of the rails 22 and the corner connector joint 76 form a substantially continuous surface.

The corner connector first and second arms 78, 80 preferably comprise one or more corner connector openings 90 located proximate to the corner connector joint 76. The corner connector openings 90 are adapted to accept the rail fasteners 70. The rail openings 72 are preferably substantially aligned with the corner connector openings 90 when the rails 22 are connected to the corner connector 74. By inserting the rail fasteners 70 through the rail openings 72 and the corner connector openings 90, the rails 22 may further be secured to the corner connector 74.

Figure 12:
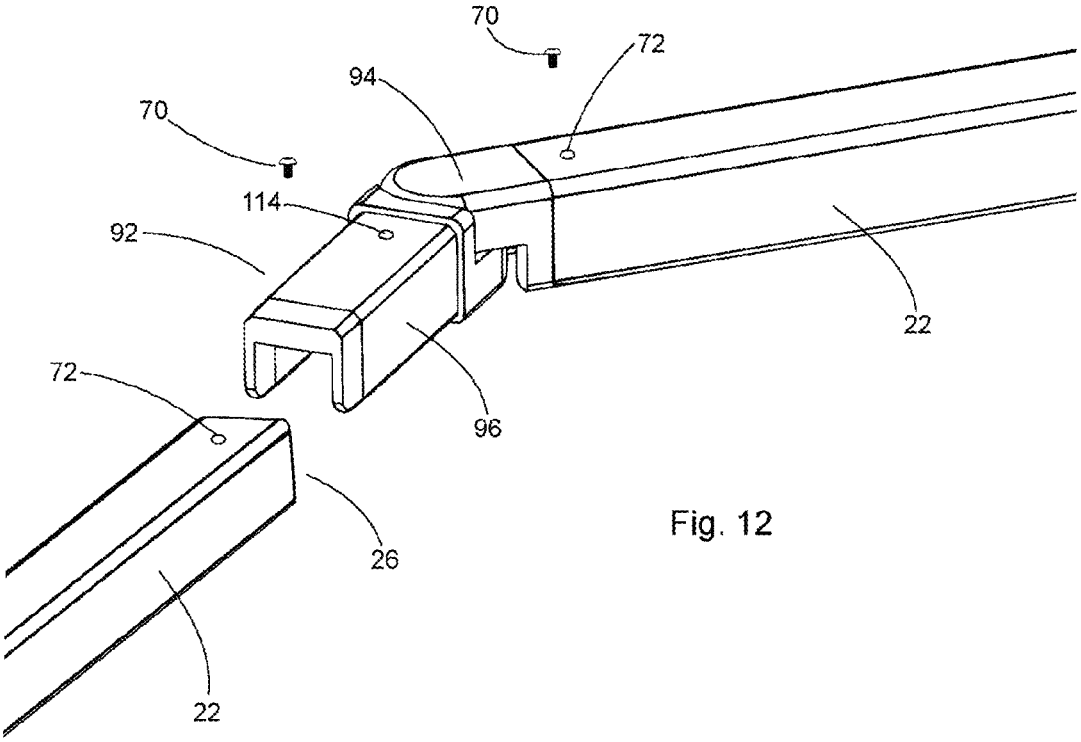
FIG. 12 is a view of an angle connector with two of the rails.
Figure 13:
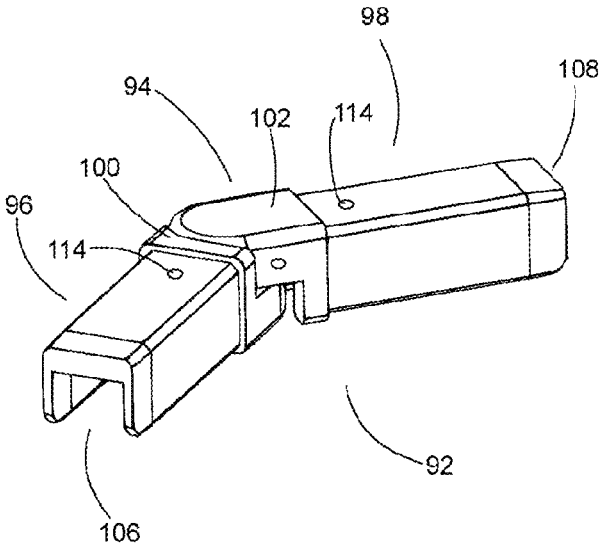
FIG. 13 is a perspective view of the angle connector, viewed from above.
Figure 14:
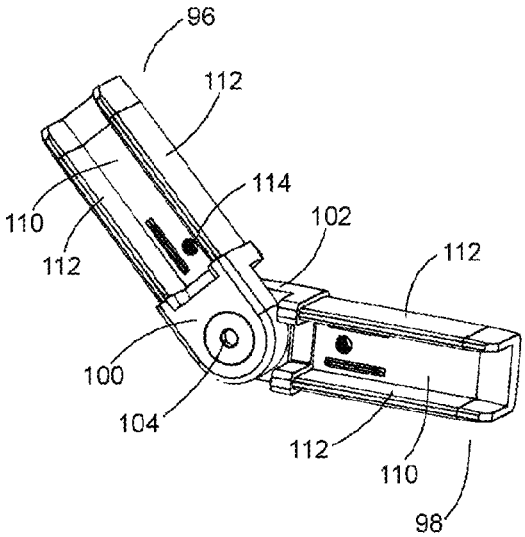
FIG. 14 is a perspective view of the angle connector, viewed from below.
Figure 15:
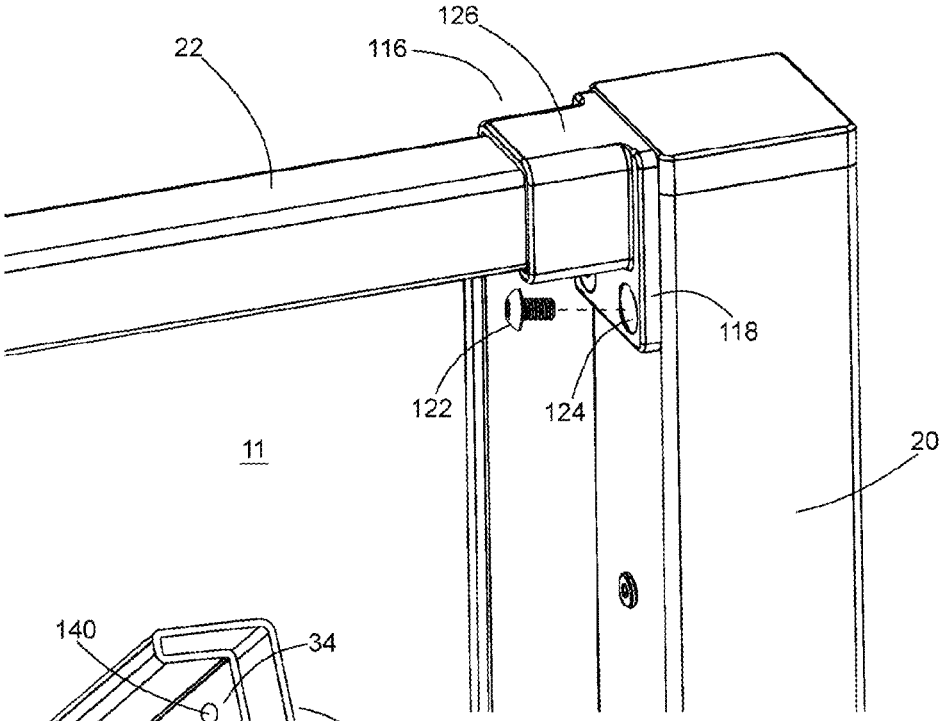
FIG. 15 is a view of a rail attached to a post with an end connector.
Figure 16:
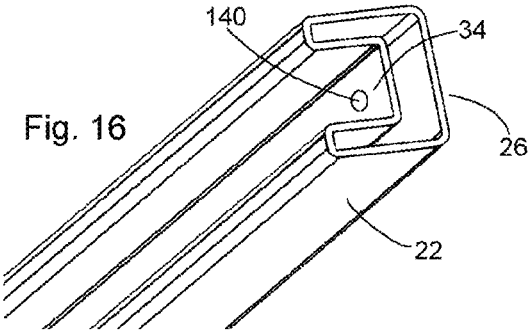
FIG. 16 shows another embodiment of the rail.

In some other situations, it may be necessary to connect two of the rails 22 in an angled alignment (e.g. between 90° and 180°). Referring to FIGS. 12 to 14, the fencing system 10 may further comprise an angle connector 92 that is configured to connect two of the rails 22 in an angled alignment. The angle connector 92 comprises an angle connector joint 94 and angle connector first and second arms 96, 98 extending from the angle connector joint 94. The angle connector joint 94 preferably comprises a pivoting mechanism that allows the angle connector first and second arms 96, 98 to be oriented at a particular angle with respect to each other. For example, the angle connector joint 94 may comprise joint first and second portions 100, 102 that are pivotably connected by a pin 104. The angle connector 92 further comprises angle connector first and second ends 106, 108 located at the far ends of the angle connector first and second arms 96, 98.

Each of the angle connector first and second arms 96, 98 comprises an angle connector planar portion 110 and a pair of angle connector descending portions 112 extending downwardly from the angle connector planar portion 110. The angle connector first end 106 is configured to engage with one of the rail ends 26 of a first one of the rails 22, while the angle connector second end 108 is configured to engage with one of the rail ends 26 of a second one of the rails 22, thereby connecting the rails 22 together.

In particular, as with the rail connector 56, the angle connector planar portion 110 and the angle connector descending portions 112 generally form an inverted U-shaped structure that is able to fit within the rail enclosure 40. For example, the angle connector planar portion 110 is able to generally fit between the upper and lower planar portions 28, 34, and the angle connector descending portions 112 are able to generally fit between the outer and inner descending portions 30, 36. Preferably, the angle connector planar portion 110 and the angle connector descending portions 112 are configured to fit snugly within the rail enclosure 40.

Referring to FIG. 13, the angle connector joint 94 preferably has a greater width and height than that of the angle connector first and second arms 96, 98. In order to connect two of the rails 22 together, one of the rail ends 26 of a first one of the rails 22 is placed around the angle connector first end 106. The first one of the rails 22 is then slid along the angle connector first arm 96 across the angle connector first end 106 until the rail end 26 contacts the angle connector joint 94, which prevents the first one of the rails 22 from sliding any further along the angle connector first arm 96. Next, one of the rail ends 26 of a second one of the rails 22 is placed around the angle connector second end 108. The second one of the rails 22 is then slid along the angle connector second arm 98 across the angle connector second end 108 until the rail end 26 contacts the angle connector joint 94, which also prevents the second one of the rails 22 from sliding any further along the angle connector second arm 98. In this manner, the first and second ones of the rails 22 may be connected together through the angle connector 92. Furthermore, the angle connector joint 94 is preferably sized such that when the rails 22 are connected, the upper planar portions 28 of the rails 22 and the angle connector joint 94 form a substantially continuous surface.

The angle connector first and second arms 96, 98 preferably comprise one or more angle connector openings 114 located proximate to the angle connector joint 94. The angle connector openings 114 are adapted to accept the rail fasteners 70. The rail openings 72 are preferably substantially aligned with the angle connector openings 114 when the rails 22 are connected to the angle connector 92. By inserting the rail fasteners 70 through the rail openings 72 and the angle connector openings 114, the rails 22 may further be secured to the angle connector 92.

As discussed above, the rails 22 extend between successive ones of the posts 20. The fencing system 10 further comprises an end connector 116 that is configured to connect one of the rails 22 to one of the posts 20. Referring to FIGS. 15 to 18, the end connector 116 comprises a post plate 118 that is adapted to engage with one of the posts 20. The post plate 118 preferably comprises one or more post plate openings 120 that are adapted to accept post fasteners 122 (such as screws, bolts, rivets, or the like). The post 20 preferably comprises post openings 124 that are also adapted to accept the post fasteners 122. The post plate openings 120 and the post openings 124 are substantially aligned to allow the end connector 116 to be secured to the post 20 using the post fasteners 122.

Figure 17:
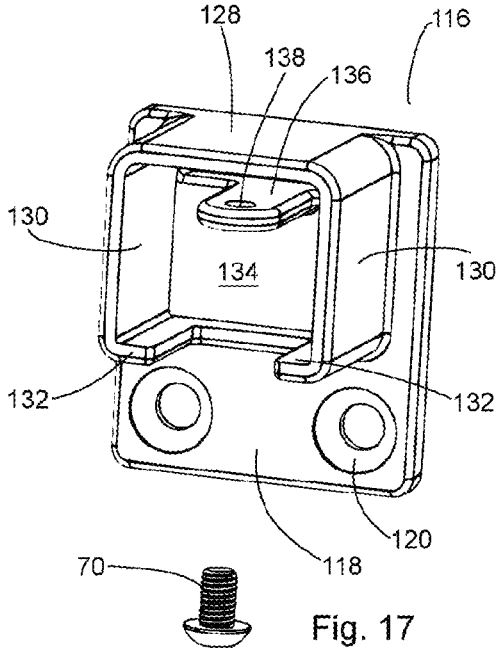
FIG. 17 is a perspective view of the end connector.
Figure 18:
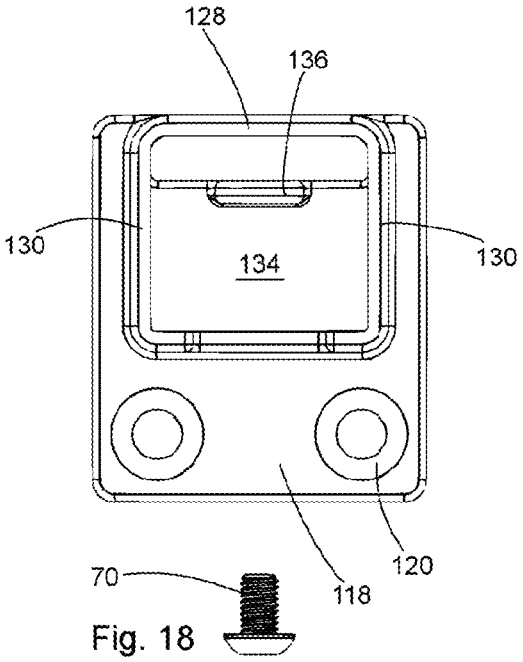
FIG. 18 is a front view of the end connector.

The end connector 116 further comprises a receiving portion 126 extending from the post plate 118 that is configured to receive one of the rail ends 26 of one of the rails 22. Referring to FIG. 17, the receiving portion 126 preferably comprises an end connector planar portion 128 and a pair of end connector descending portions 130 extending downwardly from the end connector planar portion 128. The end connector 116 may further comprise end connector ledges 132 extending inwardly from the end connector descending portions 130. The end connector planar portion 128, the end connector descending portions 130, and the end connector ledges 132 define, at least in part, an end connector enclosure 134 within which the rail end 26 of one of the rails 22 engages. Preferably, the end connector planar portion 128, the end connector descending portions 130, and the end connector ledges 132 are configured such that, during such engagement, the upper planar portion 28 of the rail 22 engages with the end connector planar portion 128, the outer descending portions 30 engage with the end connector descending portions 130, and the connector portions 38 engage with the end connector ledges 132, although this is not strictly necessary.

Referring to FIG. 17, the end connector 116 may also comprise a tongue 136 extending from the post plate 118, spaced apart from the end connector planar portion 128 and the end connector descending portions 130. Preferably, the tongue is configured to engage with the lower planar portion 34 of the rail 22 when end connector 116 engages with the rail 22. In one embodiment, the tongue 136 comprises a tongue opening 138 that is adapted to accept the rail fasteners 70. In this embodiment, the lower planar portion 34 of the rail 22 comprises rail lower openings 140 proximate to the rail end 26 that are also adapted to accept the rail fasteners 70, as shown in the embodiment of the rail 22 of FIG. 16. The rail lower openings 140 are preferably substantially aligned with the tongue openings 138 when the rail 22 is connected to the end connector 116. By inserting the rail fasteners 70 through the rail lower openings 140 and the tongue openings 138, the rail 22 may further be secured to the end connector 116.

As discussed above, the spigots 24 are adapted to support the glass panels 11. Depending on the size of the glass panels 11, each of the glass panels 11 may be supported by one or more of the spigots 24, although it is preferable that at least two of the spigots 24 support each of the glass panels 11.

Referring to FIGS. 19 to 27, each of the spigots 24 comprises a base plate 142 that is adapted to be attached to a deck or some other structure. The base plate 142 comprises one or more base plate openings 144 that are adapted to accept deck fasteners (such as screws, bolts, rivets, or the like) for securing the base plate 142 to the deck or other structure.

The spigot 24 further comprises an upright portion 148 extending from the base plate 142. The upright portion 148 comprises spigot first and second arms 150, 152 extending generally upwardly from a base 154. In one embodiment, the base 154 and the spigot first and second arms 150, 152 may be integrally formed (i.e. they form a monolithic unit). The base plate 142 may be attached to the base 154 through welding, fasteners, or the like.

Figure 22:
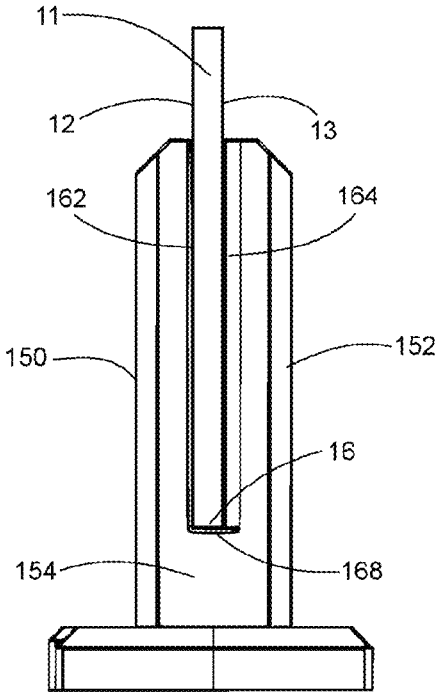
FIG. 22 is a side view of the spigot with a glass panel inserted.
Figure 23:
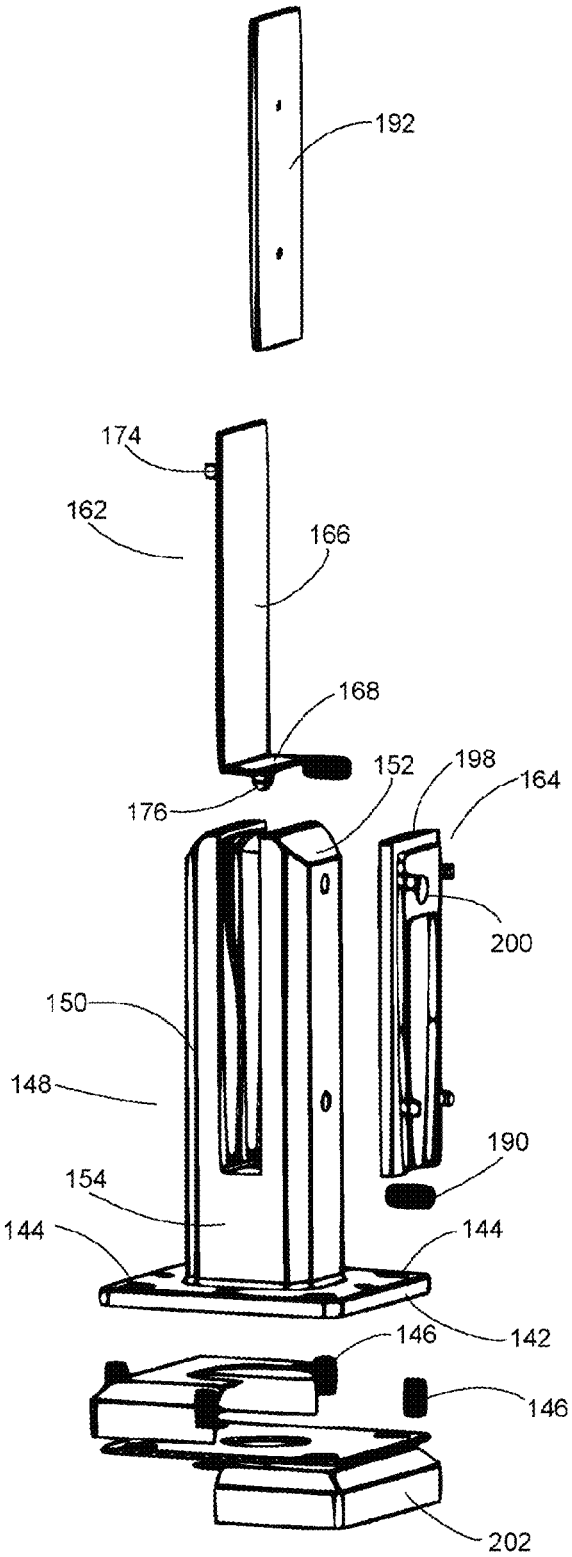
FIG. 23 is an exploded view of the spigot.

The spigot first arm 150 and the spigot second arm 152 are spaced apart from each other, with the base 154 comprising a base upper surface 156 extending between the spigot first and second arms 150, 152. The spigot first and second arms 150, 152 and the base upper surface 156 define, at least in part, a spigot channel 158 that is adapted to accept the glass panel 11. Referring to FIG. 22, when the glass panel 11 is inserted within the spigot channel 158, the spigot first arm 150 extends across a portion of the panel first face 12, and the spigot second arm 152 extends across a portion of the panel second face 13, extending from the panel lower edge 16.

The spigot 24 preferably comprises one or more pads 160 adapted to provide a cushion between the spigot first and second arms 150, 152 and the panel first and second faces 12, 13, respectively. In one embodiment, the pads 160 comprise first and second pads 162, 164. The pads 160 are preferably formed from a soft or pliable material, such as rubber, plastic, or the like, in order to provide a cushion for the glass panels 11.

Referring to FIGS. 23 to 27, in one embodiment, the first pad 162 is preferably removably attached to the spigot first arm 150 and comprises a first pad surface 166 and a lower surface 168 extending from the first pad surface 166, forming a substantially L-shaped structure. The first pad surface 166 and the lower surface 168 are located within the spigot channel 158 when the first pad 162 is attached to the spigot first arm 150. When the glass panel 11 is inserted into the spigot channel 158, the first pad surface 166 is located between the spigot first arm 150 and the panel first face 12, and the lower surface 168 is located between the base upper surface 156 and the panel lower edge 16.

The spigot first arm 150 preferably comprises a first frame 172 that faces into the spigot channel 158. The first pad 162 preferably comprises one or more first clips 174 that are adapted to engage with the first frame 172 in order to removably attach the first pad 162 to the spigot first arm 150. In one embodiment, the first clips 174 may extend from the first pad surface 166. The engagement of the first clips 174 with the first frame 172 may be through a number of means, including, but not limited to, friction fitting or deflection of the first clips 174 with respect to the first frame 172.

The first pad 162 may also comprise one or more lower protrusions 176 extending generally downwardly from the lower surface 168. The lower protrusions 176 are adapted to engage with base openings 178 formed on the base upper surface 156. The engagement of the lower protrusions 176 with the base openings 178 help to prevent lateral movement of the first pad 162 with respect to the spigot first arm 150 when the first pad 162 is attached to the spigot first arm 150.

The spigot second arm 152 preferably comprises a second frame 180 that faces into the spigot channel 158. The spigot second arm 152 further comprises a second arm surface 186 on which one or more arm openings 184 are formed thereon. The second arm surface 186 is on a side of the spigot second arm 152 that is located away from the spigot channel 158. The arm openings 184 lead to bores 188 within the spigot second arm 152 that are adapted to receive arm fasteners 190, which may be threaded, such as screws or the like.

The second pad 164 is preferably removably attached to the spigot second arm 152 and comprises a second pad surface 170. The second pad surface 170 is located within the spigot channel 158 when the second pad 164 is attached to the spigot second arm 152. The second pad 164 preferably further comprises a substantially planar plate 192 that is at least partially enclosed within the second pad 164. In one embodiment, the second pad 164 comprises a backing 194 that is spaced apart from the second pad surface 170 such that the plate 192 is able to fit between the second pad surface 170 and the backing 194. The second pad 164 may also comprise one or more sidewalls 196 extending between the second pad surface 170 and the backing 194 that restrict movement of the plate 192 when the plate 192 is between the second pad surface 170 and the backing 194. The second pad surface 170, the backing 194, and the sidewalls 196 generally define, at least in part, a plate enclosure 198 for accepting the plate 192. In one embodiment, the sidewalls 196 extend laterally between the second pad surface 170 and the backing 194, thereby restricting lateral movement of the plate 192 within the plate enclosure 198 while still allowing upward movement of the plate 192 within the plate enclosure 198.

Figure 24:
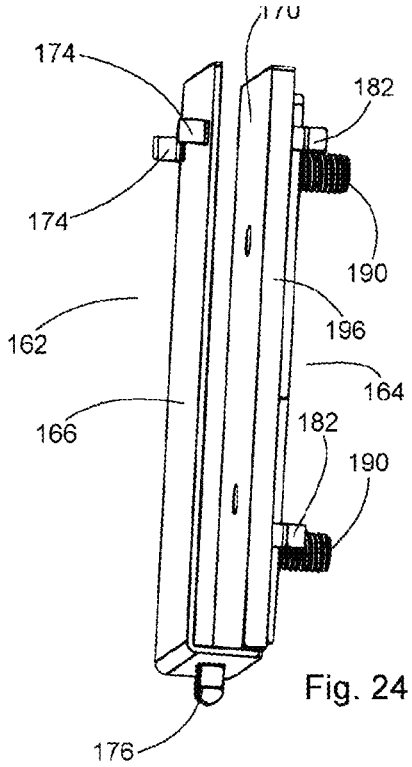
FIG. 24 is a perspective view of the first and second pads of the spigot.
Figure 25:
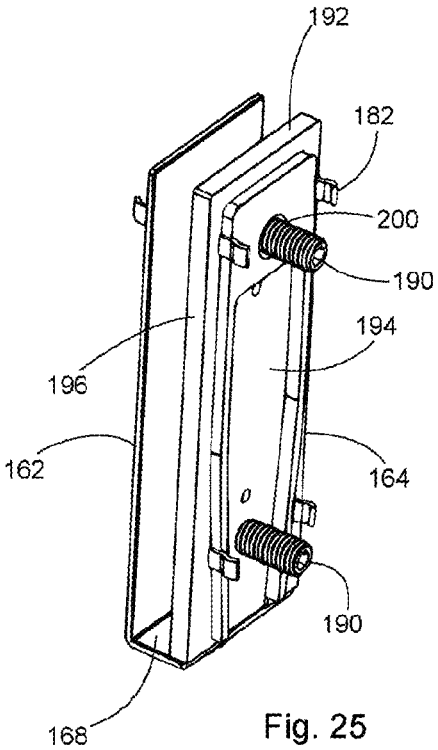
FIG. 25 is another perspective view of the first and second pads.
Figure 26:
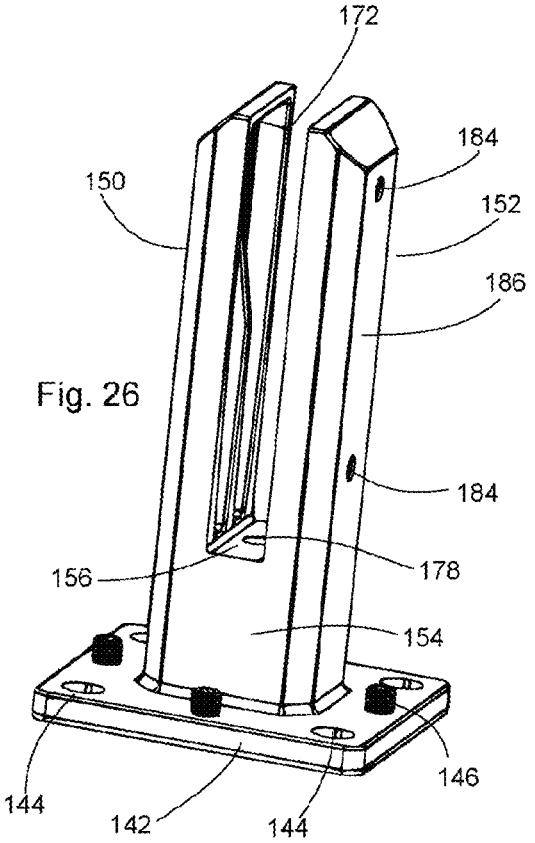
FIG. 26 is a perspective view of the spigot without the pads.
Figure 27:
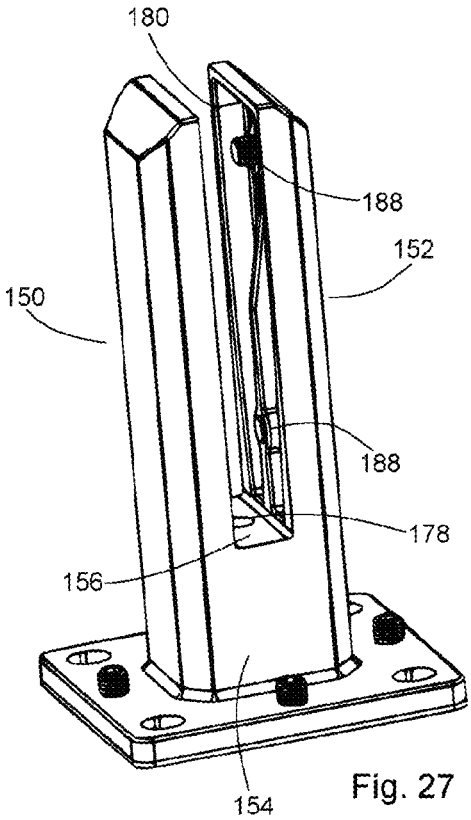
FIG. 27 is another perspective view of the spigot without the pads.

Referring to FIGS. 24 and 25, the second pad 164 preferably comprises one or more second clips 182 that are adapted to engage with the second frame 180 in order to removably attach the second pad 164 to the spigot second arm 152. In one embodiment, the second clips 182 may extend from the backing 194. The engagement of the second clips 182 with the second frame 180 may be through a number of means, including, but not limited to, friction fitting or deflection of the second clips 182 with respect to the second frame 180.

In one embodiment, the bores 188 in the spigot second arm 152 may be threaded in order to threadedly engage the arm fasteners 190. As the arm fasteners 190 are threaded through the bores 188 from the second arm surface 186, the arm fasteners 190 will eventually start to exit from the bores 188. Preferably, the backing 194 comprises backing openings 200 that substantially align with the bores 188 when the second pad 164 is attached to the spigot second arm 152. As the arm fasteners 190 exit from the bores 188, the arm fasteners 190 will pass through the backing openings 200 and come into contact with the plate 192. Further threaded movement of the arm fasteners 190 through the bores 188 and the backing openings 200 will cause further pressure from the arm fasteners 190 on the plate 192, causing the plate 192 to slightly deflect inward (in a direction into the spigot channel 158). This slight deflection of the plate 192 will in turn cause the second pad surface 186 to also be slightly deflected inward (in a direction into the spigot channel 158). This inward deflection of the second pad surface 186 will cause the second pad surface 186 to press against the panel second face 13, thereby holding the glass panel 11 in place.

The first and second pad surfaces 166, 170 may be provided with different thicknesses in order to accommodate glass panels 11 of different thicknesses. For example, if the glass panel 11 is relatively thicker, then the first pad surface 166 and/or the second pad surface 170 may need to be relatively thinner so that the first pad surface 166, the second pad surface 170, and the glass panel 11 are still able to fit within the spigot channel 158.

Figure 19:
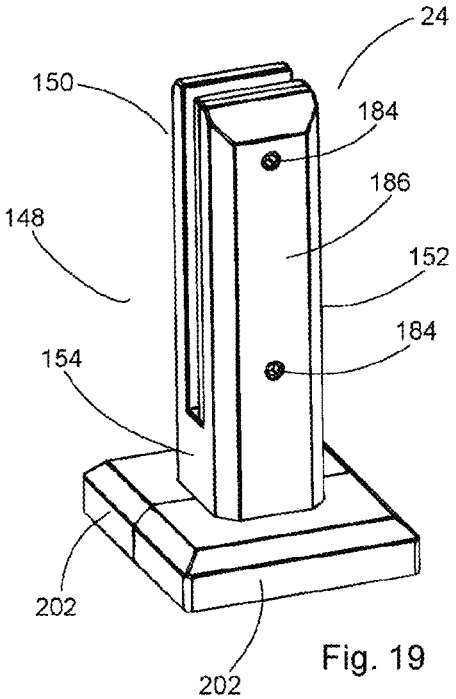
FIG. 19 is a perspective view of a spigot.
Figure 20:
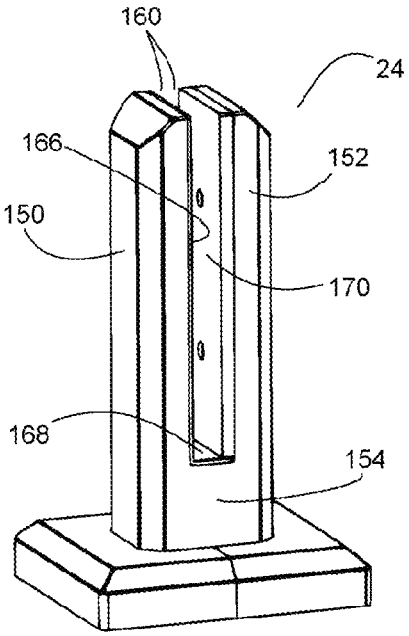
FIG. 20 is another perspective view of the spigot.
Figure 21:
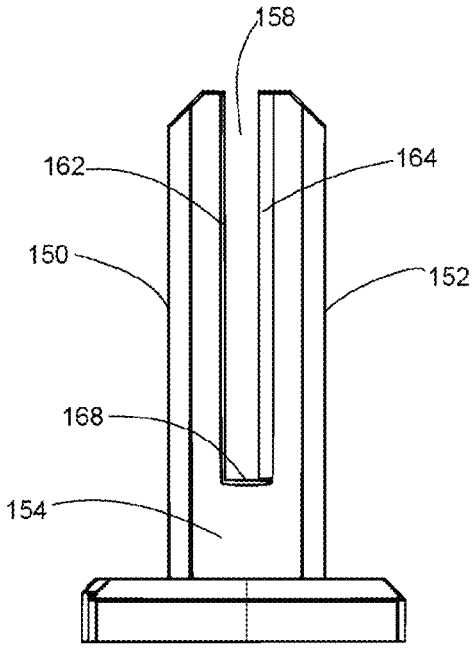
FIG. 21 is a side view of the spigot.

Referring to FIGS. 19 and 20, the spigot 24 may also comprise one or more base covers 202 that may be partially fitted over the base plate 142 in order to hide the base plate 142 from view. The base covers 202 may also cover at least a portion of a height of the base 154.

Figure 28:
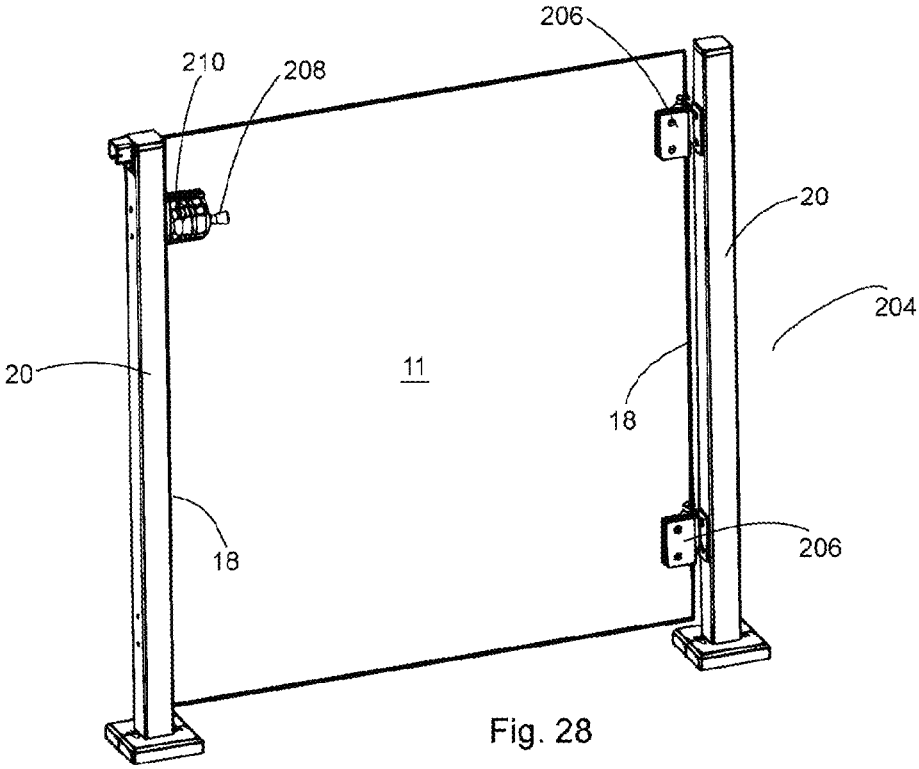
FIG. 28 is a view of a gate of the fencing system.

The fencing system 10 may also accommodate gates to allow for movement from one side of the glass panels 11 to the other side. FIG. 28 depicts one embodiment of a gate 204. The gate 204 comprises two of the posts 20 and one of the glass panels 11 extending between the posts 20. One or more hinge members 206 are attached to the glass panel 11 along one of the panel lateral edges 18. The hinge members 206 are also attached to one of the posts 20 to allow for hinged movement of the glass panel 11 with respect to the post 20. A first latch member 208 is attached to the glass panel 11 along the other one of the panel lateral edges 18. The first latch member 208 is adapted to releasably engage and disengage with a second latch member 210 attached to the other one of the posts 20. When the first latch member 208 is engaged with the second latch member 210, the glass panel 11 is prevented from hingedly moving. When the first latch member 208 is disengaged from the second latch member 210, the glass panel 11 is allowed to hingedly move. The first and second latch members 208, 210 may take the form of any one of a number of known latch mechanisms, including spring latches, slam latches, Suffolk latches, or the like.

Referring to FIG. 28, the rails 22 extend along substantially the entire length of the panel upper edges 14 of the glass panels 11. By doing so, the panel upper edges 14 are protected from impact, which could cause the glass panels 12 to break or shatter. The gaskets 44 and the first and second pad surfaces 166, 170 help to ensure that the glass panels 12 are held securely in place and that they do not move about within the fencing system 10. In addition, the softer material (e.g. rubber, plastic, etc.) used for the gaskets 44 and the first and second pad surfaces 166, 170 provides for a softer engagement for the glass panels 11. In comparison, the rails 22 and the spigot first and second arms 150, 152 may be formed from metal.

The fencing system 10 is relatively simple to install. One or more of the glass panels 11 are arranged in an end-to-end manner between two of the posts 20, with preferably two of the spigots 24 supporting each of the glass panels 11. For each of the spigots 24, the base plate 142 is secured to the deck or some other structure using the deck fasteners 146. The first and second pads 162, 164 are inserted within the spigot channel 158. The glass panel 11 is then inserted between the first and second pad surfaces 166, 170. By threading the arm fasteners 190 through the bores 188 and against the plate 192, the glass panel 11 may be held in place within the spigot channel 158.

Depending on the number and width of the glass panels 11 between the two posts 20, the number of the rails 22 required to span the distance between the two posts 20 may be determined. It may be necessary to cut one or more of the rails 22 to a particular length in order that the rails 22 correspond in length to the distance between the posts 20. The rails 16 may be joined together using one or more of the rail connectors 56, and the corner connectors 74, the angle connectors 92, depending on the orientation of the glass panels 11. The gaskets 44 may be inserted into the rail channels 42. The panel upper edges 14 of the glass panels 11 can then be inserted into the gasket channels 52. The rail ends 26 of the arrangement of the rails 22 may be attached to the posts 20 using the end connectors 116.

It will be appreciated by those skilled in the art that the preferred embodiment has been described in some detail but that certain modifications may be practiced without departing from the principles of the invention.

The invention claimed is:

1. A glass fencing system for attachment to a structure, comprising:
- a plurality of glass panels, each of the glass panels comprising a panel upper edge and a panel lower edge;
- a plurality of rails extending across the panel upper edges of the glass panels, each of the rails comprising:
  - a planar portion; and
  - a pair of descending portions extending from the planar portion;
- one or more gaskets, each of the gaskets comprising a gasket planar portion in contact with the planar portion and a pair of gasket descending portions extending from the gasket planar portion, wherein the gasket descending portions are in contact with the descending portions; and
- a plurality of spigots, each of the spigots supporting one of the glass panels, each of the spigots comprising:
  - a base;
  - a first arm extending from the base;
  - a first pad removably attached to the first arm, the first pad comprising:
    - a first pad surface in contact with the first arm and the glass panel; and
    - a lower surface extending from the first pad surface and in contact with the lower edge of the one of the glass panels; and
  - a second arm extending from the base, the second arm comprising one or more bores;
  - a second pad removably attached to the second arm, the second pad comprising:
    - a second pad surface in contact with the glass panel;
    - a backing spaced apart from the second pad surface, the backing comprising one or more backing openings aligned with the one or more bores;
    - a plate located between the second pad surface and the backing; and
    - one or more arm fasteners adapted to engage within the one or more bores, wherein the one or more arm fasteners are further adapted to pass through the one or more bores and the one or more backing openings to contact the plate.

2. The glass fencing system of claim 1, wherein each of the rails further comprises:
- an upper planar portion; and
- a pair of outer descending portions extending from the upper planar portion;
- wherein the upper planar portion is spaced apart from the planar portion, and the outer descending portions are spaced apart from the descending portions.

3. The glass fencing system of claim 2, wherein each of the rails further comprises a pair of connector portions extending between the outer descending portions and the inner descending portions.

4. The glass fencing system of claim 3, wherein the upper planar portion, the planar portion, the outer descending portions, the descending portions, and the connector portions define, at least in part, a rail enclosure.

5. The glass fencing system of claim 1, wherein the gasket planar portion and the gasket descending portions define, at least in part, a gasket channel that is adapted to receive one of the glass panels, and wherein each of the gaskets further comprises one or more gasket projections extending from the gasket descending portions into the gasket channel, the one or more gasket projections adapted to grip one of the glass panels.

6. The glass fencing system of claim 4, further comprising one or more connectors adapted to join two of the rails together, wherein the connectors comprise one or more of the following: a rail connector, a corner connector, and an angle connector.

7. The glass fencing system of claim 6, wherein the rail connector comprises:
- a rail connector planar portion; and
- a pair of rail connector descending portions extending from the rail connector planar portion;
- wherein the rail connector planar portion and the rail connector descending portions are adapted to engage with the rail enclosure of both of the two of the rails.

8. The glass fencing system of claim 6, wherein the corner connector comprises corner connector first and second arms, each of the corner connector first and second arms comprising:
- a corner connector planar portion; and
- a pair of corner connector descending portions extending from the corner connector planar portion;
- wherein the corner connector first arm is adapted to engage with the rail enclosure of a first one of the two rails; and
- wherein the corner connector second arm is adapted to engage with the rail enclosure of a second one of the two rails.

9. The glass fencing system of claim 6, wherein the angle connector comprises:
- angle connector first and second arms; and
- an angle connector joint connected to the angle connector first and second arms, the angle connector joint adapted to allow for pivoting of the angle connector first arm with respect to the angle connector second arm;
- wherein each of the angle connector first and second arms comprises:
  - an angle connector planar portion; and
  - a pair of angle connector descending portions extending from the angle connector planar portion;
- wherein the angle connector first arm is adapted to engage with the rail enclosure of a first one of the two rails; and wherein the angle connector second arm is adapted to engage with the rail enclosure of a second one of the two rails.

10. The glass fencing system of claim 1 further comprising one or more posts, wherein one of the rails is adapted to attach to each of the one or more posts.

11. The glass fencing system of claim 10 further comprising an end connector adapted to attach the one of the rails to the one or more posts.

12. The glass fencing system of claim 1, wherein the first pad further comprises one or more first clips extending from the first pad surface, wherein the first arm comprises a first frame, and wherein the one or more first clips are adapted to engage the first frame to removably attach the first pad to the first arm.

13. The glass fencing system of claim 1, wherein the first pad further comprises one or more lower protrusions extending from the lower surface, wherein the base comprises one or more base openings, and wherein the one or more lower protrusions are adapted to engage with the one or more base openings when the first pad is attached to the first arm.

14. The glass fencing system of claim 1, wherein the second pad further comprises one or more sidewalls extending between the second pad surface and the backing, and wherein the sidewalls, the second pad surface, and the backing define, at least in part, a plate enclosure for accepting the plate.

15. The glass fencing system of claim 1, wherein the bores are threaded, and wherein the one or more arm fasteners are adapted to threadedly engage with the one or more bores.

16. The glass fencing system of claim 15, wherein contact of the one or more arm fasteners with the plate causes the plate to deflect in a direction against the second pad surface.

17. The glass fencing system of claim 16, wherein deflection of the plate against the second pad surface causes the second pad surface to press against the glass panel.

18. The glass fencing system of claim 1, wherein the second pad further comprises one or more second clips extending from the backing, wherein the second arm comprises a second frame, and wherein the one or more second clips are adapted to engage the second frame to removably attach the second pad to the second arm.

19. The glass fencing system of claim 1, wherein each of the spigots further comprise a base plate attached to the base, wherein the base plate is adapted to be attached to the structure, and wherein the base plate comprises one or more base plate openings adapted to receive deck fasteners for attaching the base plate to the structure.

20. A spigot for use in supporting a glass panel in a glass fencing system, the spigot comprising:

a base;

a first arm extending from the base;

a first pad removably attached to the first arm, the first pad comprising:

a first pad surface in contact with the first arm and the glass panel; and a lower surface extending from the first pad surface and in contact with the lower edge of the one of the glass panel; and a second arm extending from the base, the second arm comprising one or more bores;

a second pad removably attached to the second arm, the second pad comprising:

a second pad surface in contact with the glass panel;

a backing spaced apart from the second pad surface, the backing comprising one or more backing openings aligned with the one or more bores;

a plate located between the second pad surface and the backing; and one or more arm fasteners adapted to engage within the one or more bores, wherein the one or more arm fasteners are further adapted to pass through the one or more bores and the one or more backing openings to contact the plate.

* * * * *